US009607468B2

(12) United States Patent
Cornell et al.

(10) Patent No.: US 9,607,468 B2
(45) Date of Patent: Mar. 28, 2017

(54) GLARE REDUCTION FOR WAGERING GAMES

(71) Applicant: WMS Gaming Inc., Waukegan, IL (US)

(72) Inventors: Bradley D. Cornell, LaGrange, IL (US); Timothy C. Loose, Chicago, IL (US); Scott A. Massing, Lincolnwood, IL (US); Miguel A. Vega, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 632 days.

(21) Appl. No.: 13/788,186

(22) Filed: Mar. 7, 2013

(65) Prior Publication Data

US 2014/0094301 A1 Apr. 3, 2014

Related U.S. Application Data

(60) Provisional application No. 61/707,311, filed on Sep. 28, 2012.

(51) Int. Cl.
*G07F 17/32* (2006.01)

(52) U.S. Cl.
CPC ..... *G07F 17/3216* (2013.01); *G07F 17/3211* (2013.01)

(58) Field of Classification Search
CPC .... G02B 5/02; G07F 17/3216; G07F 17/3211
USPC ..... 463/46, 34
See application file for complete search history.

(56) References Cited

U.S. PATENT DOCUMENTS

| | | | |
|---|---|---|---|
| 4,306,768 | A | 12/1981 | Egging |
| 4,454,670 | A | 6/1984 | Bachmann et al. |
| 4,517,558 | A | 5/1985 | Davids |
| 4,562,433 | A | 12/1985 | Biferno |
| 4,568,928 | A | 2/1986 | Biferno |
| 5,752,881 | A | 5/1998 | Inoue |

(Continued)

OTHER PUBLICATIONS

3M Privacy and Screen Protectors: 3M Privacy Innovation. [online] [Retrieved on Apr. 30, 2014]. Retrieved from the Internet: <URL: http://solutions.3m.com/wps/portal/3M/en_US/3MScreens_NA/Protectors/Why_Screen_Privacy/3M_Privacy_Innovation/> (2 pages).

*Primary Examiner* — Kang Hu
*Assistant Examiner* — Jeffrey Wong
(74) *Attorney, Agent, or Firm* — Nixon Peabody LLP

(57) ABSTRACT

A gaming machine has a cabinet with a cabinet frame, a display device, a light source, and a directional transmissible layer with directional light planes arranged parallel to and offset from each other. The display device is located within the cabinet frame and is configured to display a wagering game. The light source is positioned above the display device, within the cabinet frame, and emits direct light and indirect light towards a player position in front of the gaming machine. The indirect light reflects off the display device prior to reaching the player position, causing light glare towards the player position. To reduce or eliminate the light glare, the directional transmissible layer is placed at least in part over the light source such that the directional light planes are horizontally aligned with the display device to prevent at least some of the indirect light from reflecting off the display device.

20 Claims, 5 Drawing Sheets

(56) References Cited

U.S. PATENT DOCUMENTS

| | | | | |
|---|---|---|---|---|
| 5,858,139 | A | 1/1999 | Ouderkirk et al. | |
| 6,517,433 | B2 | 2/2003 | Loose et al. | |
| 7,001,060 | B1 | 2/2006 | Kimura | |
| 7,097,560 | B2 | 8/2006 | Okada | |
| 7,730,413 | B1 | 6/2010 | Engel et al. | |
| 8,216,068 | B2 | 7/2012 | Kishi | |
| 2003/0116270 | A1* | 6/2003 | Hawa et al. | 156/307.1 |
| 2006/0111169 | A1* | 5/2006 | Hornik | G07F 17/32 463/16 |
| 2008/0144179 | A1* | 6/2008 | Mimura | G02B 5/005 359/599 |
| 2010/0069160 | A1 | 3/2010 | Barrett et al. | |
| 2010/0234099 | A1 | 9/2010 | Rasmussen et al. | |

* cited by examiner

GLARE REDUCTION FOR WAGERING GAMES

CROSS-REFERENCE TO RELATED APPLICATIONS

This application claims the benefit of and priority to U.S. Provisional Patent Application No. 61/707,311, titled "Glare Reduction For Wagering Games" and filed on Sep. 28, 2012, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a glare reduction feature for a gaming machine.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally, gaming machines operate under control of a processor that has been programmed to execute base games and bonus games in which reel arrays spin and stop to display symbol combinations in a display area. If winning combinations are achieved by the symbol combinations, awards are provided to the players.

SUMMARY OF THE INVENTION

According to one aspect of the present invention, a gaming machine has a cabinet including a cabinet frame facing a player position in front of the gaming machine. The gaming machine also has at least one display device within the cabinet frame and configured to display a wagering game, and at least one light source positioned above the display device and within the cabinet frame. The light source emits direct light and indirect light towards the player position in front of the gaming machine. The indirect light reflects off the display device prior to reaching the player position and causes light glare towards the player position. The gaming machine further has at least one directional transmissible layer having a plurality of directional light planes parallel to and offset from each other. The directional transmissible layer is placed at least in part over the light source such that the directional light planes are horizontally aligned with the display device to prevent at least some of the indirect light from reflecting off the display device.

According to another aspect of the invention, a gaming machine has a cabinet including a cabinet frame facing a player position in front of the gaming machine, and a primary display device within the cabinet frame and configured to display a wagering game. The gaming machine also has a secondary display device within the cabinet frame and positioned above the primary display device, the secondary display device being configured to display features related to the wagering game. The gaming machine further has at least one illuminated artwork and at least one directional transmissible layer. The artwork is positioned above the primary display device and within the cabinet frame, and has a light source emitting direct light and indirect light towards the player position in front of the gaming machine. The indirect light reflects off the primary display device prior to reaching the player position and causes light glare towards the player position. The directional transmissible layer covers the illuminated artwork and has a plurality of directional light planes arranged parallel to and offset from each other. The directional light planes are aligned horizontally with the primary display device such that at least some of the indirect light from the light source is prevented from reflecting off the primary display device. Thus, the directional transmissible layer reduces or eliminates the light glare.

According to yet another aspect of the invention, a gaming system is configured to conduct a wagering game. The gaming system includes one or more cabinets with a cabinet frame facing a player position in front of the cabinet frame, one or more input devices, and one or more display devices positioned within a respective cabinet frame and configured to display a wagering game. The gaming system also includes one or more processors and one or more memory devices storing instructions. The instructions, when executed by the at least one or more processors, cause the gaming system to receive an input, via the one or more input devices, indicative of a wager, and display on the one or more display devices a randomly selected outcome of the wagering game. The gaming system further includes at least one light source and at least one directional transmissible layer. The light source is positioned above a respective display device of the one or more display devices and emits direct light and indirect light towards a respective player position in front of the gaming machine. The indirect light reflects off the respective display device prior to reaching the respective player position and causes light glare towards the respective player position. The directional transmissible layer has a plurality of directional light planes that are parallel to and offset from each other. The directional transmissible layer is placed at least in part over the light source such that the directional light planes are horizontally aligned with the display device to prevent at least some of the indirect light from reflecting off the display device.

Additional aspects of the invention will be apparent to those of ordinary skill in the art in view of the detailed description of various embodiments, which is made with reference to the drawings, a brief description of which is provided below.

Figure 1:
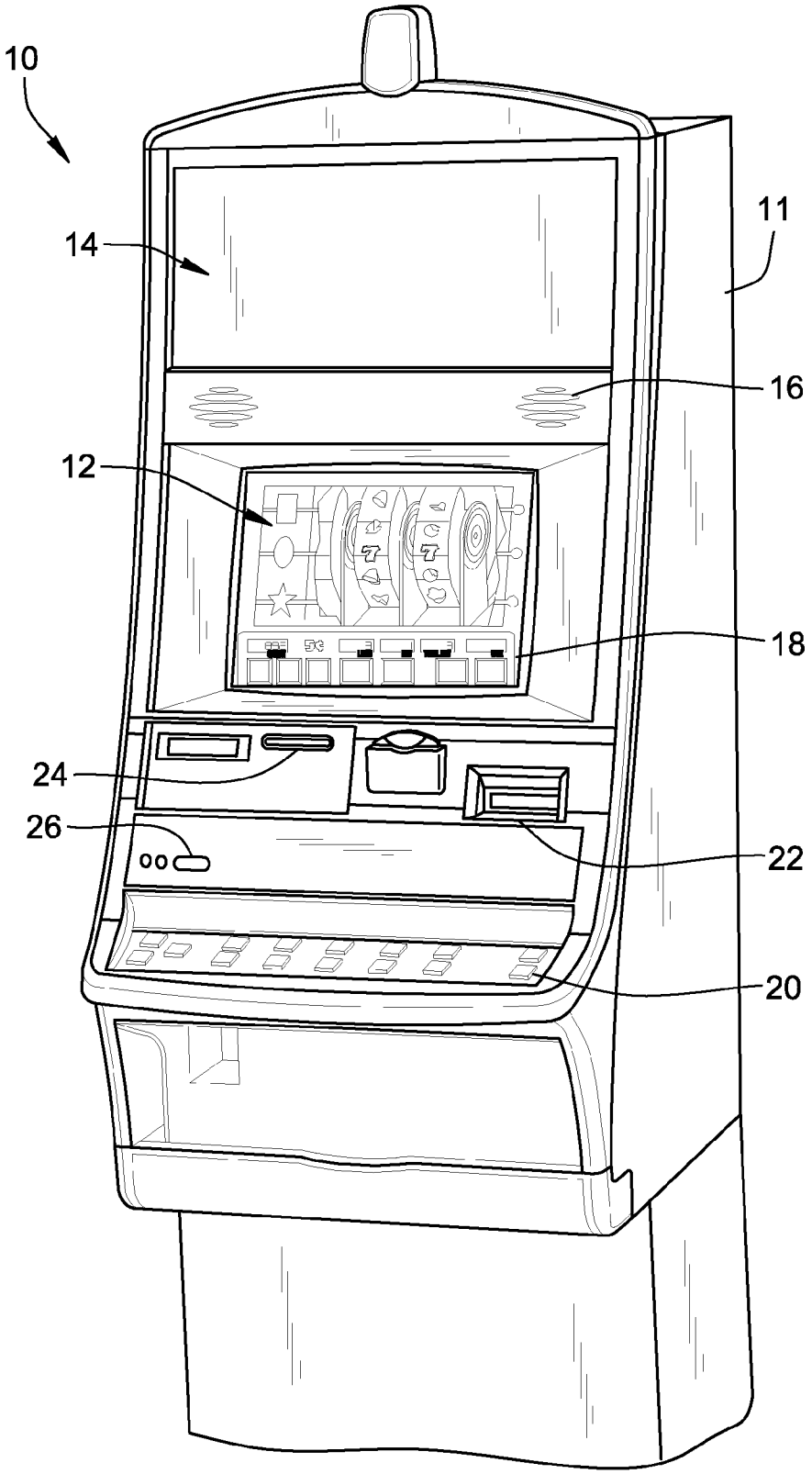
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
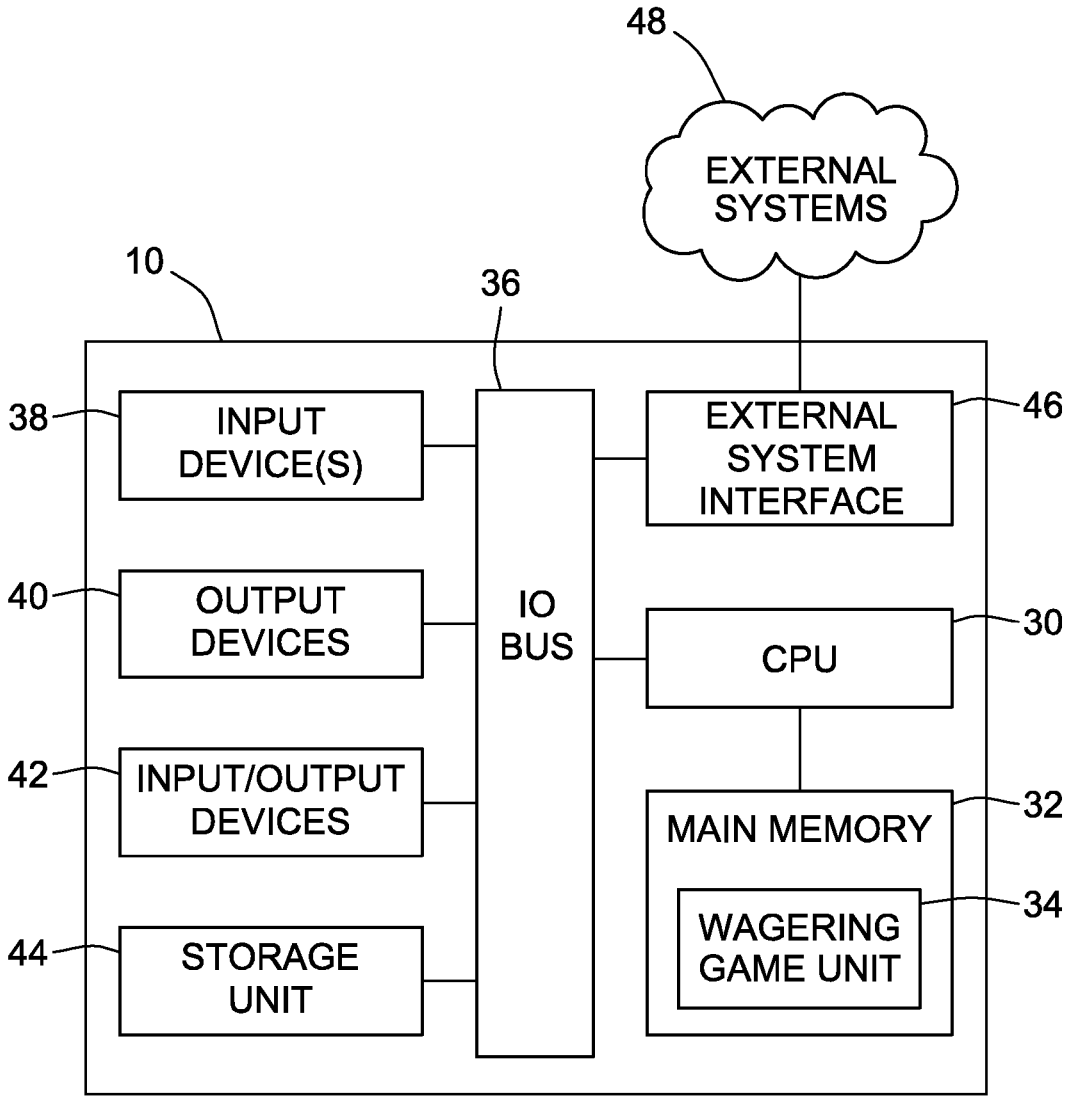
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
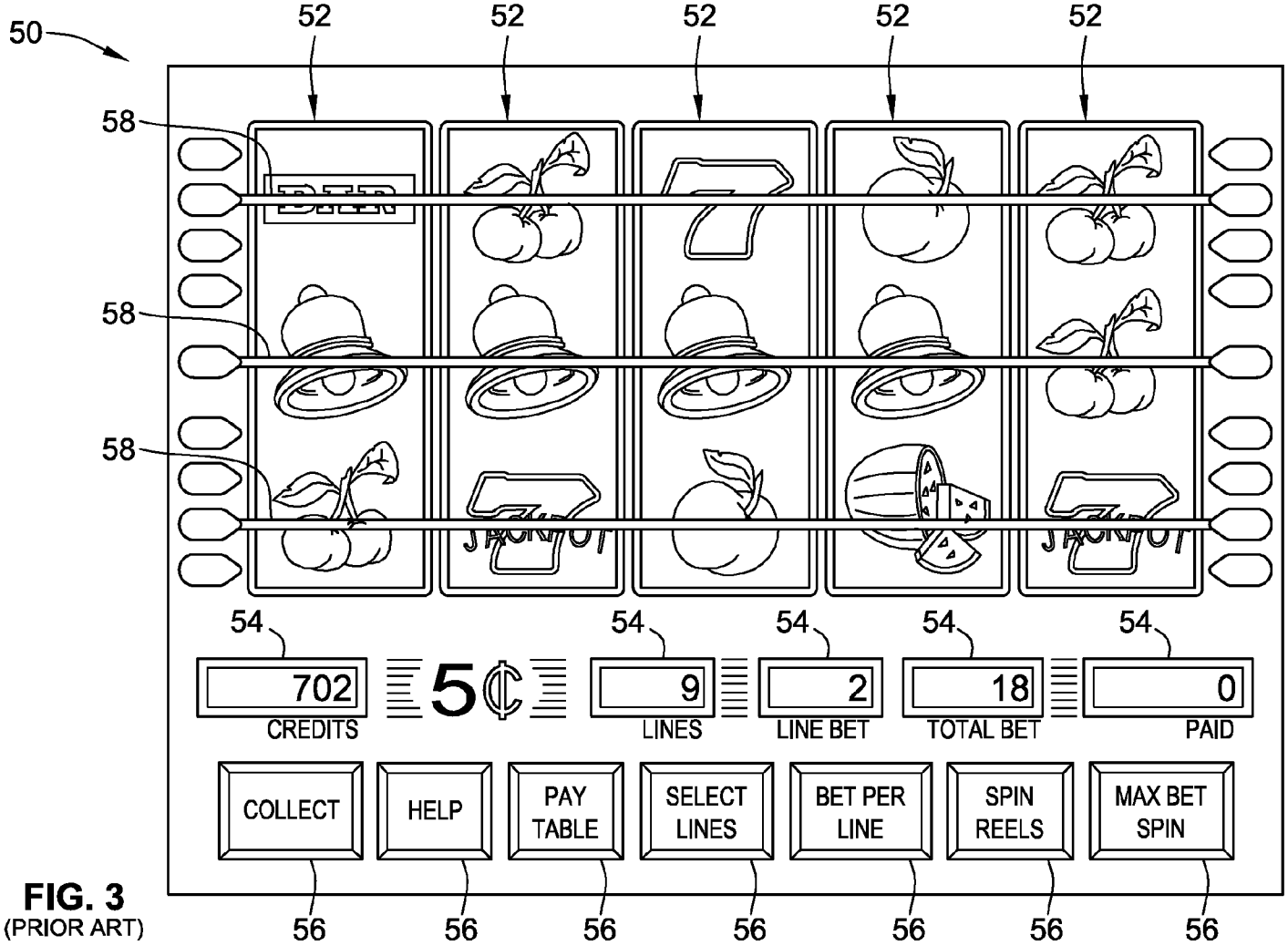
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 5:
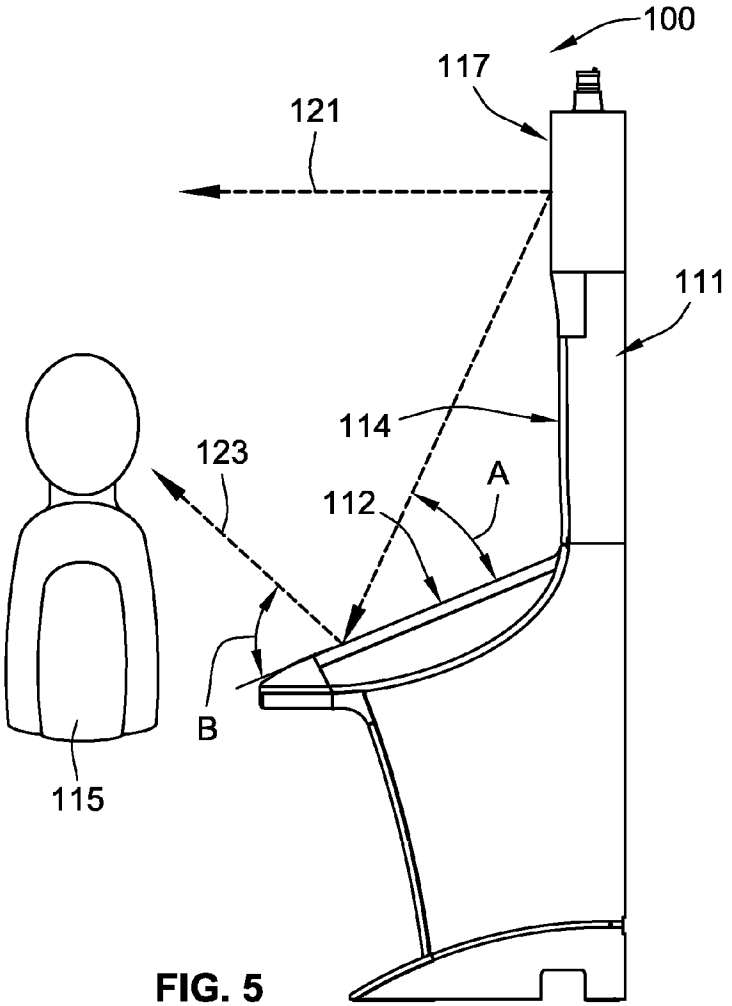
FIG. 5 is a side illustration of the gaming machine of FIG. 4.
Figure 4:
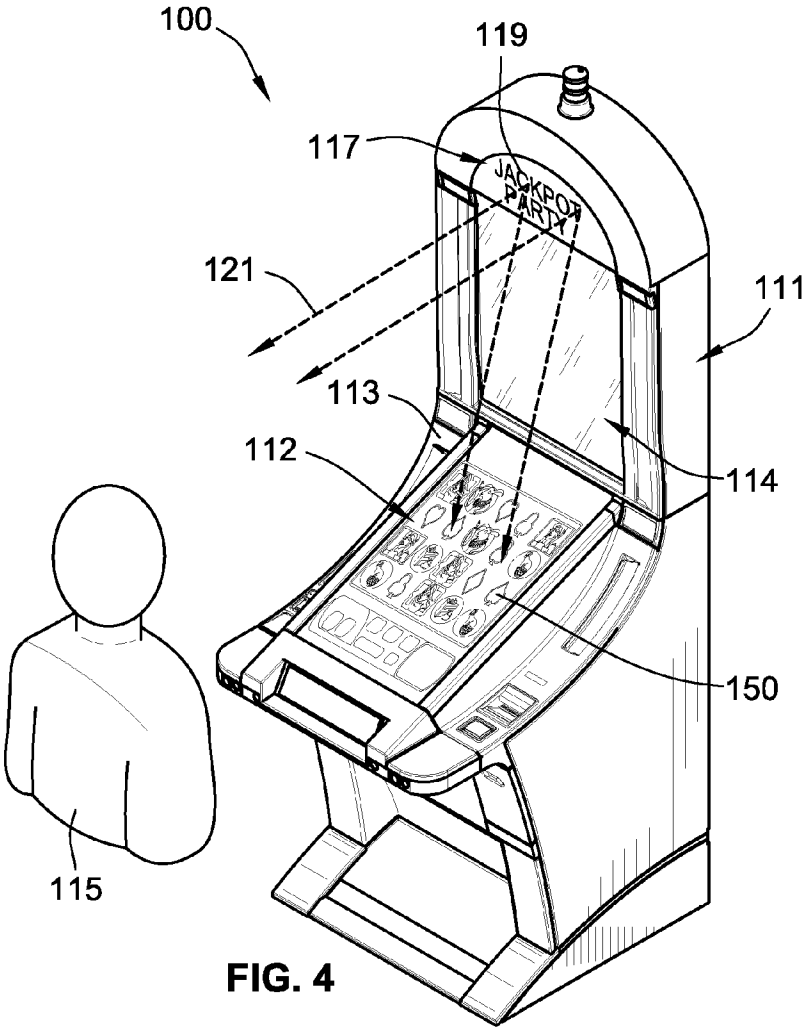
FIG. 4 is a perspective illustration of a gaming machine in which a top light source causes light glare in a primary display.

Referring now to FIGS. 4 and 5, a gaming machine 100 has a cabinet 111 that may house various input devices, output devices, and input/output devices. The gaming machine 100 is similar, but not identical, to the gaming terminal 10 illustrated in FIG. 1. The gaming machine 100 includes a primary display area 112 and a secondary display area 114, each of which being a mechanical-reel display, a video display, or a combination thereof in which a transmissive video display is disposed in front of the mechanical-reel display to portray a video image superimposed upon the mechanical-reel display.

The cabinet 111 has a cabinet frame 113 facing a player position 115 in front of the gaming machine 100. The primary and secondary display areas 112, 114 are positioned within the cabinet frame 113 and are configured to display a wagering game. For example, the primary display area 112 is configured to show a basic-game screen 150 that may be similar to the basic-game screen 50 described in reference to FIG. 3. The secondary display area 114 is configured to show a similar image and/or other images. The primary display area 112 is located below the secondary display area 114 and angled towards the player position 115. The secondary display area 114 is generally positioned in a vertical orientation parallel to the player position 115.

The cabinet 111 further includes a top area 117 having illuminated artwork 119, which can be backlit, front-lit or edge-lit by any light source, including incandescent, fluorescent, LEDs, neon, and cold cathode fluorescent lamp (CCFL). In the illustrated example, the artwork 119 shows a "JACKPOT PARTY" title. In other examples, the artwork 119 can be any other illuminated wagering and non-wagering information, including information for purposes of attracting players and non-players to the gaming machine 100. The top area 117 and/or the secondary display area 144 can be part of a modular top-box integrated within the cabinet 111.

The light source of the illuminated artwork 119 emits direct light 121 towards the player position 115 and indirect light 123. The indirect light 123 reflects off the primary display area 112 prior to reaching the player position 115. More specifically, the indirect light 123 causes light glare towards the player position 115 and, generally, interferes with a player's gameplay experience. For example, the glare reduces or eliminates altogether a player's visualization of gameplay illustrations presented on the primary display area 112. In fact, the glare becomes more prominent (and problematic) at certain combinations of (a) an angle A (shown in FIG. 5) between the illuminated artwork 118 and the primary display area 112, (b) an angle B (shown in FIG. 5) between the player position 115 and the primary display 112, and (c) the spacing between the illuminated artwork 118, the primary display area 112, and the player position 115. The spacing and angles A and B tend to promote a reflection of the illuminated artwork 119, especially when the angles A and B are similar to each other.

Figures 6, 7, 8:
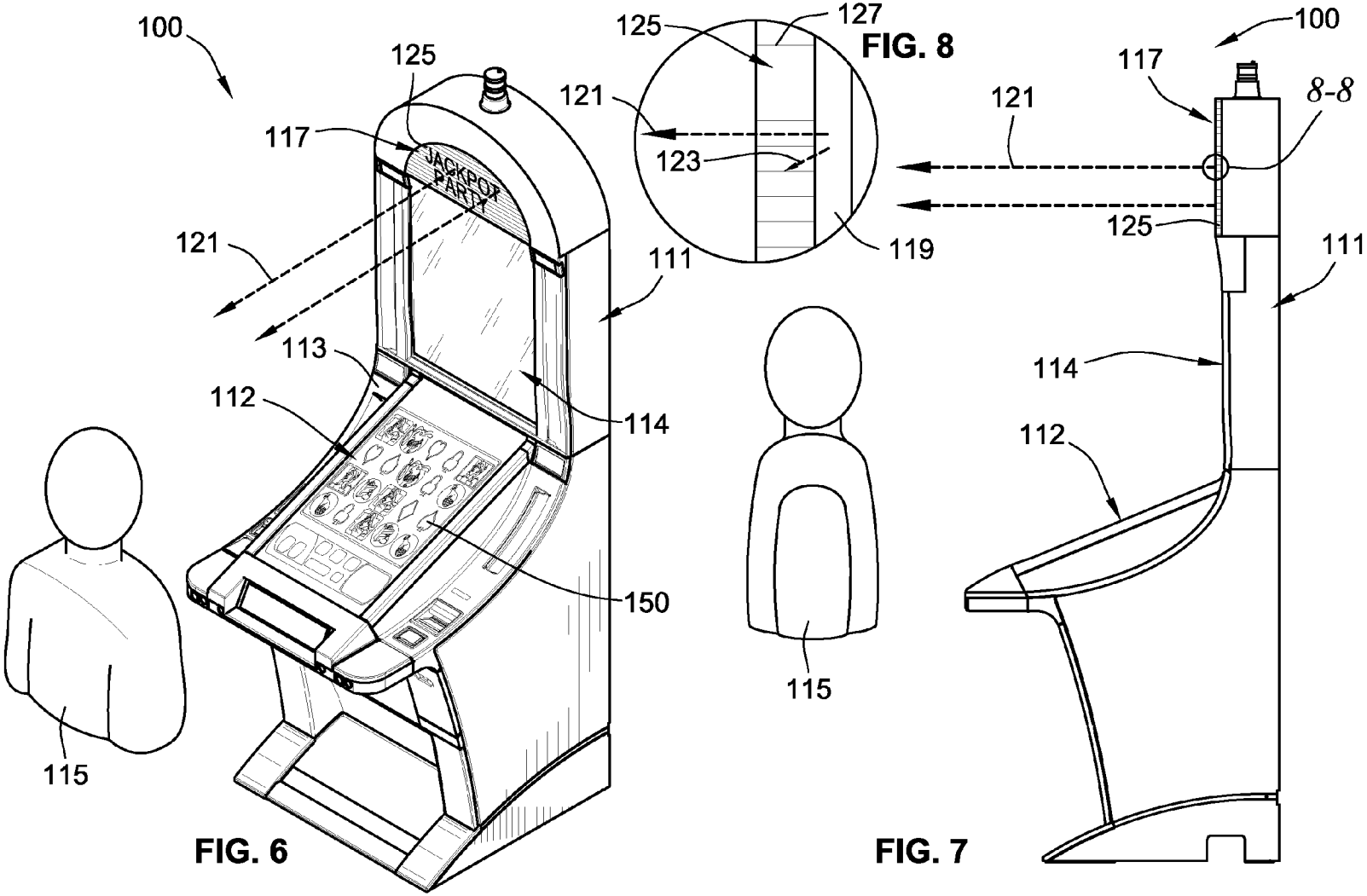
FIG. 6 is a perspective illustration of a gaming machine in which a directional transmissible layer prevents light glare, from a top light source, in a primary display.
FIG. 7 is a side illustration of the gaming machine of FIG. 6.
FIG. 8 is an enlarged illustration of a directional transmissible layer attached to the top light source of the gaming machine of FIG. 6.

Referring to FIGS. 6-8, the gaming machine 100 has been modified to include a directional transmissible layer 125 to cover the illuminated artwork 119. The directional transmissible layer 125 eliminates, or greatly reduces, the glare caused by the indirect light 123. Specifically, the directional transmissible layer 125 prevents light rays emitted towards the primary display area 112 from reaching the primary display area 112.

According to one example, the directional transmissible layer 125 is a privacy filter manufactured by 3M for protecting privacy of mobile devices, tablets, laptops, etc. The 3M privacy filter is a sheet of polymeric microlouver film that includes microlouver technology intended to block unwanted side glances. The microlouver technology includes microlouvers that act, figuratively, as window blinds (e.g., "venetian blinds") such that light is allowed in a direction parallel to the "venetian blinds" but is blocked in a non-parallel direction. As such, the 3M privacy filter has an intended orientation that allows transmission of light towards the user (i.e., in the direction parallel to microlouver layers), but blocks the transmission of light towards other side observers (i.e., in a non-parallel direction to the microlouver layers). If the 3M privacy filter is oriented in a different direction, the user of a mobile device having a 3M privacy filter will not be able to view images emitted by the mobile device. Thus, except for the intended orientation, the 3M privacy filter will not function as intended.

Nevertheless, in accordance with a novel use, the 3M privacy filter is applied to the illuminated artwork 119 in an orientation different than the intended orientation. For example, the 3M privacy filter is applied in a direction that is 90 degrees rotated relative to its intended orientation. In FIG. 8, illustrative microlouvers 127 are oriented horizontally to allow the direct light 121 to pass through the directional transmissible layer 125 but block the indirect light 123. As such, the microlouvers 127 are, generally, directional light planes parallel to and offset from each other, and horizontally aligned with the primary display area 112 to prevent at least some of the indirect light 123 from reflecting off the primary display area 112.

The horizontal orientation is in reference to a vertical distance between the primary display area 112 and the top area 117. As such, the directional transmissible layer 125 reduces or eliminates light glare that typically interferes with gameplay visualization. If the 3M privacy filter would have been oriented in its intended orientation, i.e., with the "venetian blinds" 127 oriented vertically, the glare caused by indirect light 123 would remain a problem for the player 115.

The 3M privacy filter is attached to the top area 117 with an adhesive or other attachment means. In one example, the adhesive is a 3M adhesive that can be removed cleanly, with no residue. Optionally, the 3M privacy filter includes a filter layer that allows only some of the direct light 121 to provide a dimming (i.e., less bright) light effect to the illuminated artwork 119.

Instead of or in addition to the directional transmissible layer 125 being applied to the top area 117, the directional transmissible layer 125 can be selectively applied to the secondary display device 114 and to other illuminated artwork in the cabinet 111. Also, although the illuminated artwork 119 has been referred to as having a single light source, it is understood that the illuminated artwork 119 can have a plurality of light sources. Thus, a top-box that may incorporate the secondary display area 114 and the top area 117 may have a plurality of light sources for illuminating game related artwork. One or more of the light sources can be covered at least in part by a respective directional transmissible layer for preventing indirect light being reflected off the primary display device 112.

According to another example, the directional transmissible layer 125 is a polymeric film having a generally planar first major surface, an opposite second major surface, and first and second opposite ends. The polymeric film is adapted to direct light from objects (displayed on an illuminated panel) adjacent the second major surface only to persons looking at the objects from predetermined orientations relative to the first major surface of the polymeric film.

The polymeric film includes a main portion having a generally rectangular cross section and defining the first major surface. The polymeric film further includes a plurality of elongate parallel contiguous ridge portions joined to and projecting less than 2 millimeters from a side of the main portion opposite the first major surface. The ridge portions define the second major surface, each of the ridge portions having an elongate obscured second major surface portion. The ridge portions, figuratively speaking, function as the illustrative window blinds 127. In general, the polymeric film provides light transmission between its first major surface and its second major surface, and includes means for restricting light transmission through the obscured second major surface portions. As such, for example, the polymeric film allows an intended user at one end of the polymeric film (in an intended orientation) to view the objects but prevents an observer at another end of the polymeric film from viewing the objects. A more detailed description of the polymeric film is provided in U.S. Pat. No. 5,858,139, titled "Composite Used For Light Control Or Privacy," issued on Jan. 12, 1999 to Andrew J. Ouderkirk et al, which is incorporated herein by reference in its entirety.

Each of these embodiments and obvious variations thereof is contemplated as falling within the spirit and scope of the claimed invention, which is set forth in the following claims.

What is claimed is:

1. A gaming machine comprising:

a cabinet including a cabinet frame facing a player position in front of the gaming machine;

at least one display device within the cabinet frame and configured to display a wagering game;

at least one light source positioned above the display device and within the cabinet frame, the light source emitting direct light and indirect light towards the player position in front of the gaming machine, the indirect light reflecting off the display device prior to reaching the player position, the indirect light causing light glare towards the player position; and at least one directional transmissible layer placed at least in part over the light source, the transmissible layer having a plurality of directional light planes parallel to and offset from each other, the directional light planes being horizontally aligned with the display device to prevent at least some of the indirect light from reflecting off the display device.

2. The gaming machine of claim 1, wherein the at least one directional transmissible layer is a privacy film.

3. The gaming machine of claim 1, wherein the directional light planes are microlouvers for controlling transmission of light.

4. The gaming machine of claim 1, further comprising an additional display device within the cabinet frame and positioned above the at least one display device, the at least one light source being part of the additional display device.

5. The gaming machine of claim 1, wherein the at least one light source displays game related artwork.

6. The gaming machine of claim 1, further comprising a top-box having a plurality of light sources for illuminating game related artwork, each of the plurality of light source being covered at least in part by a respective directional transmissible layer for preventing indirect light being reflected off the at least one display device.

7. The gaming machine of claim 1, wherein the at least one directional transmissible layer is a sheet of polymeric film attached to the at least one light source with an adhesive.

8. The gaming machine of claim 1, wherein the at least one directional transmissible layer includes a filter layer for allowing transmission of only some of the direct light.

9. A gaming machine comprising:

a cabinet including a cabinet frame facing a player position in front of the gaming machine;

a primary display device within the cabinet frame and configured to display a wagering game;

a secondary display device within the cabinet frame and positioned above the primary display device, the secondary display device being configured to display features related to the wagering game;

at least one illuminated artwork positioned above the primary display device and within the cabinet frame, the illuminated artwork having a light source emitting direct light and indirect light towards the player position in front of the gaming machine, the indirect light reflecting off the primary display device prior to reaching the player position, the indirect light causing light glare towards the player position; and at least one directional transmissible layer covering the illuminated artwork and having a plurality of directional light planes arranged parallel to and offset from each other, the directional light planes being aligned horizontally with the primary display device such that at least some of the indirect light from the light source is prevented from reflecting off the primary display device, the directional transmissible layer reducing or eliminating the light glare.

10. The gaming machine of claim 9, wherein the at least one directional transmissible layer is a privacy film.

11. The gaming machine of claim 9, wherein the directional light planes are microlouvers for controlling transmission of light.

12. The gaming machine of claim 9, wherein the illuminated artwork is included in the secondary display device.

13. The gaming machine of claim 9, further comprising a top-box having a plurality of light sources for illuminating game related artwork, each of the plurality of light source being covered at least in part by a respective directional transmissible layer for preventing indirect light being reflected off the primary display device.

14. The gaming machine of claim 9, wherein the at least one directional transmissible layer is a sheet of polymeric film attached to the at least one light source with an adhesive.

15. The gaming machine of claim 9, wherein the at least one directional transmissible layer includes a filter layer that allows transmission of only some of the direct light.

16. The gaming machine of claim 9, wherein at least one of the primary display device and the secondary display device has a portrait orientation relative to the player position.

17. A gaming system configured to conduct a wagering game, the gaming system comprising:

one or more cabinets including a cabinet frame facing a player position in front of the cabinet frame;

one or more input devices;

one or more display devices positioned within a respective cabinet frame and configured to display a wagering game;

one or more processors;

one or more memory devices storing instructions that, when executed by the at least one or more processors, cause the gaming system:

receive an input, via the one or more input devices, indicative of a wager, and display on the one or more display devices a randomly selected outcome of the wagering game; and at least one light source positioned above a respective display device of the one or more display devices, the light source emitting direct light and indirect light towards a respective player position in front of the gaming machine, the indirect light reflecting off the respective display device prior to reaching the respective player position, the indirect light causing light glare towards the respective player position; and at least one directional transmissible layer having a plurality of directional light planes parallel to and offset from each other, the directional transmissible layer being placed at least in part over the light source such that directional light planes are horizontally aligned with the display device to prevent at least some of the indirect light from reflecting off the display device.

18. The gaming system of claim 17, wherein the at least one directional transmissible layer is a privacy film and the plurality of directional light planes includes microlouvers.

19. The gaming system of claim 17, wherein the at least one directional transmissible layer includes a filter layer that allows transmission of only some of the direct light.

20. The gaming system of claim 17, wherein the at least one directional transmissible layer is a sheet of polymeric film attached to the at least one light source with an adhesive.

* * * * *